US010253392B2

(12) United States Patent
Hamada et al.

(10) Patent No.: US 10,253,392 B2
(45) Date of Patent: Apr. 9, 2019

(54) APPARATUS FOR TREATING MAGNETIC WIRE AND METHOD FOR TREATING THE SAME

(71) Applicant: AICHI STEEL CORPORATION, Tokai-shi (JP)

(72) Inventors: Norihiko Hamada, Tokai (JP); Akihiro Shimode, Tokai (JP)

(73) Assignee: AICHI STEEL CORPORATION, Tokai-shi (JP)

( * ) Notice: Subject to any disclaimer, the term of this patent is extended or adjusted under 35 U.S.C. 154(b) by 0 days.

(21) Appl. No.: 15/622,369

(22) Filed: Jun. 14, 2017

(65) Prior Publication Data

US 2018/0363095 A1 Dec. 20, 2018

(51) Int. Cl.

| | |
|---|---|
| ***C21D 9/56*** | (2006.01) |
| ***F27D 19/00*** | (2006.01) |
| ***C21D 11/00*** | (2006.01) |
| ***F27D 21/00*** | (2006.01) |

(Continued)

(52) U.S. Cl.

CPC ..... *C21D 11/00* (2013.01); *C21D 9/525* (2013.01); *C21D 9/564* (2013.01); *F27D 19/00* (2013.01); *F27D 21/00* (2013.01); *F27D 2003/0034* (2013.01); *F27D 2019/0003* (2013.01)

(58) Field of Classification Search

CPC ..... C21D 11/00; C21D 9/525; C21D 9/564; C21D 9/54; F27D 19/00; F27D 21/00; F27D 2019/0003; F27D 2003/0034

USPC ..... 266/78; 148/403, 304, 559, 657, 601; 428/606; 164/462, 463, 479

See application file for complete search history.

(56) References Cited

U.S. PATENT DOCUMENTS

| | | | |
|---|---|---|---|
| 4,527,614 | A | 7/1985 | Masumoto et al. |
| 4,574,604 | A | 3/1986 | Vogel et al. |
| 4,781,771 | A | 11/1988 | Masumoto et al. |

(Continued)

FOREIGN PATENT DOCUMENTS

| | | |
|---|---|---|
| JP | 5950265 | 7/2016 |
| WO | WO 2009/119081 | 10/2009 |

OTHER PUBLICATIONS

Hamada et al., U.S. Office Action dated Nov. 3, 2017, directed to U.S. Appl. No. 15/709,133; 10 pages.

(Continued)

*Primary Examiner* — Keith D. Hendricks
*Assistant Examiner* — Michael Aboagye
(74) *Attorney, Agent, or Firm* — Morrison & Foerster LLP

(57) ABSTRACT

Apparatus for heat treating magnetic wire includes a wire supply unit, a wire property measuring unit, a wire tensile force measuring unit, a heat treatment unit, and a wire winding unit. The wire supply unit includes a supply bobbin, a supply rotary part, a wire reel, and a tension roller. The wire property measuring unit includes a size measuring device, an after measurement capstan, and a wire reel and measures a size of the wire prior to the heat treatment. The wire tensile force measuring unit includes a tensile force measuring device, a tension roller, and a wire reel. The wire heat treatment unit includes a heat treatment furnace, a temperature measuring device, an after heat treatment capstan, and a wire reel. The wire winding unit includes a winding bobbin, a winding rotary part that rotates the winding bobbin, a tension roller, and a wire reel.

6 Claims, 3 Drawing Sheets

(51) Int. Cl.
*C21D 9/52* (2006.01)
*F27D 3/00* (2006.01)

(56) References Cited

U.S. PATENT DOCUMENTS

| | | | | |
|---|---|---|---|---|
| 4,782,994 | A | 11/1988 | Raybould et al. | |
| 4,872,923 | A * | 10/1989 | Borodin | C21D 1/20 148/559 |
| 5,366,569 | A * | 11/1994 | Muller | B23K 9/013 148/525 |
| 7,603,883 | B2 * | 10/2009 | Quick | B21C 1/003 72/286 |
| 8,099,991 | B2 * | 1/2012 | Zhang | B21F 99/00 140/149 |
| 2017/0101697 | A1 * | 4/2017 | Honkura | C21D 9/525 |

OTHER PUBLICATIONS

Petition to Institute Derivation Proceeding of U.S. Appl. No. 15/289,334, by Aichi Steel Corporation, U.S. Appl. No. 15/622,369, Case No. DER2018-00012, Apr. 12, 2018; 91 pages.
Petition to Institute Derivation Proceeding of U.S. Appl. No. 15/289,334, by Aichi Steel Corporation, U.S. Appl. No. 15/709,133, Case No. DER2018-00014, Apr. 13, 2018; 98 pages.
Exhibit 1003, Declaration of Norihiko Hamada, for U.S. Appl. No. 15/622,369, Apr. 11, 2018, Case No. DER2018-00012; 46 pages.
Exhibit 1004, Declaration of Michiharu Yamamoto, for U.S. Appl. No. 15/622,369, Apr. 10, 2018, Case No. DER2018-00012; 21 pages.
Exhibit 1005, Declaration of Hiroaki Asano, for U.S. Appl. No. 15/622,369, Apr. 10, 2018, Case No. DER2018-00012; 15 pages.
Exhibit 1006, Assessment of Tension-Annealing in the Zhukov Wire (Japanese Original), Sep. 8, 2006; 12 pages.
Exhibit 1007, Assessment of Tension-Annealing in the Zhukov Wire (English Translation), Sep. 8, 2006; 13 pages.
Exhibit 1008, Method for Examining the Metal Core Diameter (Japanese Original), Dec. 13, 2006; 11 pages.
Exhibit 1009, Method for Examining the Metal Core Diameter (English Translation), Dec. 13, 2006; 12 pages.
Exhibit 1010, Starting Continuous TA Device Unit 3 (Japanese Original), Mar. 25, 2009; 41 pages.
Exhibit 1011, Starting Continuous TA Device Unit 3 (English Translation), Mar. 25, 2009; 42 pages.
Exhibit 1012, TA Device Draft No. 2 (Japanese Original), Apr. 1, 2008; 1 page.
Exhibit 1013, TA Device Draft No. 2 (English Translation), Apr. 1, 2008; 2 pages.
Exhibit 1014, VTA Device Check Point No. 1 (Japanese Original), Oct. 29, 2008; 1 page.
Exhibit 1015, VTA Device Check Point No. 1 (English Translation), Oct. 29, 2008; 2 pages.
Exhibit 1016, Design Examination Minutes (DR1+DR3) (Japanese Original), May 25, 2010; 1 page.
Exhibit 1017, Design Examination Minutes (DR1+DR3) (English Translation), May 25, 2010; 2 pages.
Exhibit 1018, Design Examination Meeting Materials for TA System to Mass-produce Amorphous Wire to Build a System Able to Achieve 12 Million Sensors/Month—DR1+3 (Japanese Original), May 25, 2010; 37 pages.
Exhibit 1019, Design Examination Meeting Materials for TA System to Mass-produce Amorphous Wire to Build a System Able to Achieve 12 Million Sensors/Month—DR1+3 (English Translation), May 25, 2010; 38 pages.
Exhibit 1020, Design Examination Minutes (DR5) (Japanese Original), Jul. 3, 2011; 1 page.
Exhibit 1021, Design Examination Minutes (DR5) (English Translation), Jul. 3, 2011; 2 pages.
Exhibit 1022, Model Transition Examination Materials (DR5) for TA System to Mass-produce Amorphous Wire to Build a System Able to Achieve 12 Million Sensors/Month (Japanese Original), Jul. 2, 2011; 48 pages.
Exhibit 1023, Model Transition Examination Materials (DR5) for TA System to Mass-produce Amorphous Wire to Build a System Able to Achieve 12 Million Sensors/Month (English Translation); Jul. 2, 2011; 49 pages.
Exhibit 1024, MagneDesign Email Communication Thursday, Sep. 5, 2013 1012 AM (Japanese Original); 2 pages.
Exhibit 1025, MagneDesign Email Communication Thursday, Sep. 5, 2013 1012 AM (English Translation), Nov. 9, 2017; 3 pages.
Exhibit 1026, MagneDesign Email Communication Thursday, Sep. 5, 2013 450 PM (Japanese Original); 1 page.
Exhibit 1027, MagneDesign Email Communication Thursday, Sep. 5, 2013 450 PM (English Translation), Nov. 9, 2017; 2 pages.
Exhibit 1028, MagneDesign Email Communication Thursday, Sep. 5, 2013 450 PM Attachment; 1 page.
Exhibit 1029, MagneDesign Email Communication Thursday, Sep. 5, 2013 915 PM (Japanese Original); 2 pages.
Exhibit 1030, MagneDesign Email Communication Thursday, Sep. 5, 2013 915 PM (English Translation) Nov. 9, 2017; 4 pages.
Exhibit 1031, MagneDesign Email Communication Friday, Sep. 6, 2013 900 AM (Japanese Original); 3 pages.
Exhibit 1032, MagneDesign Email Communication Friday, Sep. 6, 2013 900 AM (English Translation) Nov. 9, 2017; 4 pages.
Exhibit 1033, MagneDesign Email Communication Friday, Sep. 6, 2013 900 AM Attachment (Japanese Original); 1 page.
Exhibit 1034, MagneDesign Email Communication Friday, Sep. 6, 2013 900 AM Attachment (English Translation) Nov. 9, 2017; 2 pages.
Exhibit 1035, Aichi Steel's USB Log (Japanese Original); 29 pages.
Exhibit 1036, Aichi Steel's USB Log (English Translation), Nov. 9, 2017; 27 pages.
Exhibit 1037, Aichi Steel's Base Model (Japanese Original); 1 page.
Exhibit 1038, Aichi Steel's Base Model (English Translation), Nov. 9, 2017; 2 pages.
Hamada et al., U.S. Office Action dated Feb. 14, 2018, directed to U.S. Appl. No. 15/709,133; 9 pages.
Hamada et al., U.S. Office Action dated Oct. 15, 2018, directed to U.S. Appl. No. 15/709,133; 6 pages.

* cited by examiner

APPARATUS FOR TREATING MAGNETIC WIRE AND METHOD FOR TREATING THE SAME

BACKGROUND OF THE INVENTION

Field of the Invention

This invention relates to apparatus that performs a heat treatment on fine magnetic wires under a tensile force to improve magnetic properties of the fine wires by controlling the temperature and the stress of the magnetic wires. The invention also relates to a method of heat treatment of magnetic wires practiced by the apparatus.

Description of the Related Art

FG sensors and MI sensors are known as magnetic sensors that can detect magnetism with high accuracy. MI sensors include, as a magnetism detecting body, highly fine amorphous magnetic wires having a diameter of about 10-100 μm and are expected to be used in variety of applications, including electronic compasses, medical sensors, and security sensors. The amorphous magnetic wires used as the magnetism detecting body determine the performance of the magnetic sensors that depend on the magnetic properties of the magnetic wires. Accordingly, it is crucial that the quality of magnetic properties of the amorphous magnetic wires is stably maintained when they are mass produced.

Amorphous wires undergo rapid cooling and are then subject to heat treatment under a tensile force condition, so as to adjust the magnetic properties to be used in a specific magnetic sensor. In order to obtain magnetic properties suitable for use as a magnetic sensor, it is necessary to maintain the state of amorphous by controlling the heating temperature and period to avoid crystallization. In particular, the heating temperature is usually about 400° C.-550° C. Further, it is better to have a higher heating temperature in the temperature range to avoid crystallization because the feed speed of the magnetic wires can be raised to improve productivity.

While the stress induced in the magnetic wires during the heat treatment must be within the elastic limit to avoid irreversible elongation of the magnetic wires, a higher stress causes a smaller hysteresis. At around 550° C., the greater the stress is, the greater the anisotropic magnetic field (Hk) becomes. The Hk is the maximum magnetic field that provides a liner relationship in the hysteresis diagram. Accordingly, when the magnetic wires that are heat treated near that temperature with a higher stress are used as the magnetism detecting body, the range of magnetic sensing becomes wider while the sensitivity becomes lower. Thus, the magnetic properties of the magnetic wires vary depending on the conditions of the heat treatment of the magnetic wires under a tensile force.

Accordingly, there has been a long-felt need for magnetic wire heat treatment apparatus that can produce magnetic wires having magnetic properties satisfying specifications of various magnetic sensors with predetermined qualities in a stable manner while the heat treatment conditions are adjusted flexibly and accurately. One example of the conventional heat treatment apparatus in this art is described in International Publication No. WO2009/119081, which discloses a heat treatment for magnetic wires to be used in an MI sensor.

SUMMARY OF THE INVENTION

The conventional magnetic wire heat treatment apparatus, such as the one disclosed in the publication above, does not have provisions of producing magnetic wires with specified magnetic properties in a stable manner when the magnetic wires are mass produced. When a long magnetic wire having a length, for example of one kilometer or longer, is heat treated for mass production, the tensile force must be controlled to produce magnetic wires of specified properties in a stable manner throughout the long length of the magnetic wire. Further, maintaining the tensile force at a constant value would not produce the magnetic wire in a stable manner because the diameter of the magnetic wire does vary along the length of the magnetic wire, resulting in producing varying stresses depending on the location of the magnetic wire having varying diameters. In addition, the magnetic wire tends to elongate in the heat treatment furnace because of the high temperature, resulting in a change in the stress induced in the magnetic wire in the furnace when the tensile force and the feed speed are kept constant.

In order to mass produce amorphous magnetic wires that are used as a magnetism detecting body of a magnetic sensor, an extremely long magnetic wire, for example one kilometer long or longer, must be heat treated continuously in one batch, as explained above. In such cases, the size change along the length of the long magnetic wire or the change in the mechanical properties in the furnace, especially the elongation of the wire, must be accounted for. Accordingly, there has been a need for magnetic wire heat treatment apparatus that can produce magnetic wires with specified properties in a stable manner even when the size of the magnetic wire changes along its length or elongates in the furnace.

In view of the current problem in this art described above, the invention is directed to heat treatment apparatus that mass produces amorphous magnetic wires by heat treating a long amorphous magnetic wire continuously in one batch so that the produced magnetic wire has specified magnetic properties throughout the length of the wire, despite the size change along the length of the long magnetic wire or the change in the mechanical properties in the furnace.

The invention provides apparatus for heat treating magnetic wire that includes a wire supply unit, a wire property measuring unit, a wire tensile force measuring unit, a heat treatment unit, and a wire winding unit. The wire supply unit includes a supply bobbin, around which the magnetic wire to be heat treated is wound, a supply rotary part that rotates the supply bobbin, a wire reel, and a tension roller. The wire property measuring unit includes a size measuring device, an after measurement capstan, and a wire reel and measures a size of the wire prior to the heat treatment. The wire tensile force measuring unit includes a tensile force measuring device, a tension roller, and a wire reel. The wire heat treatment unit includes a heat treatment furnace, a temperature measuring device, an after heat treatment capstan, and a wire reel. The wire winding unit includes a winding bobbin, around which the heat treated magnetic wire is wound, a winding rotary part that rotates the winding bobbin, a tension roller, and a wire reel.

In the apparatus, based on the size of the magnetic wire measured by the size measuring device, the tensile force measured by the tensile force measuring device, the temperature of the heat treatment furnace measured by the temperature measuring device, and the winding speed of the winding bobbin, the tensile force of the magnetic wire between the supply bobbin and the winding bobbin is adjusted using the tension roller, and the winding speed of the winding bobbin is adjusted using the supply rotary unit, the after measurement capstan, the after heat treatment capstan, and the winding rotary part, so that the temperature and the induced stress of the magnetic wire in the furnace are maintained in predetermined ranges.

The invention is based on the inventors' insights described below. First, the inventors have discovered that the stresses induced in the magnetic wire can be maintained in a predetermined range even when the size of the magnetic wire changes along its length or the mechanical properties of the wire change in the furnace, if the size of the magnetic wire and the tensile force applied to the wire prior to the insertion to the furnace are accurately measured so as to determine the tensile force to be applied to the wire in view of the stress to be induced in the magnetic wire, and the determined tensile force, and thus the stress, is maintained in a predetermined range by controlling the feed speed of each of the rotary parts, the feed speed of each of the capstans, and the load applied to the wire by the tension roller placed between the capstans.

Next, the two capstans are used in the apparatus based on the following insight. The two capstans are placed before and after the heat treatment furnace, respectively, and are rotary devices that can adjust the rotating speed. An accurate control of the stress is required when the magnetic wire is heat treated, as explained above. Without a feed speed control mechanism, such as a capstan, an accurate control of the stress induced in the magnetic wire in the furnace would be practically impossible, especially when the magnetic wire elongates in the furnace during the heat treatment. This could even lead to a fracture of the magnetic wire. In addition, the friction against the wire reels could lower the tension, thus lowering the stress in the furnace.

One of the features of the apparatus is that the two capstans placed before and after the furnace isolate the region of the magnetic wire between the capstans, including the region of the furnace, from other regions of the magnetic wire so as to minimize the effect of the varying stress induced in the magnetic wire outside the region between the two capstans. It is possible to accurately control the stress induced in the magnetic wire in the furnace by controlling the feed speed of the two capstans placed before and after the furnace. Accordingly, the fracture of the magnetic wire due to the elongation of the magnetic wire in the furnace and the lowering of the stress due to the friction can be avoided.

However, the stress induced in the magnetic wire is not the lone factor to be controlled to assure stable production of the magnetic wire with specified magnetic properties. The temperature of the magnetic wire must be also controlled. To this end, the inventors have discovered that the temperature of the magnetic wire in the furnace is determined by the following three factors: the temperature of the furnace; the wire diameter; and the time wire stays within the furnace, based on empirical approach. Although the effects of these factors on the wire temperature depend on the design of the furnace and the materials used, the effects should be determined based on a few experiments. As a result, it is possible to control the wire temperature with a good accuracy based on the length of the furnace, the temperature set for the furnace and the feed speed.

While a greater stress within the elastic limit of the wire alloy gives rise to a smaller hysteresis, a higher heat treatment temperature leads to the elongation of the wire and thus reduction of the wire diameter, resulting in the change in the stress induced in the magnetic wire. The interplay of the stress and the heat temperature must be considered to produce magnetic wires with specified magnetic properties. The stress depends on the tensile force applied to the wire and the diameter of the wire and also depends on the amount of the elongation of the wire in the furnace due to the high temperature. In view of this, the tensile force measuring device is placed just in front of the furnace to measure the tensile force applied to the wire accurately. In addition, the wire diameter and the tensile force of the magnetic wire are measured continuously and the load of the tension roller is controlled so that the measured values fall in the predetermined ranges.

The magnetic wire that is heat treated by the apparatus is, for example, a bare wire without any coatings, which is made by a rotating liquid spinning process, such as those disclosed in U.S. Pat. Nos. 4,527,614 and 4,781,771. Alternatively, a magnetic wire coated with an insulating layer, such as a glass layer, can be also heat treated by the apparatus. When the magnetic wire with an insulating coating is heat treated, the apparatus needs to measure both the diameter of the wire including the insulating layer and the diameter of the wire without the insulating layer, based on which the stress induced in the wire without insulating layer is calculated as the stress for the tensile heat treatment in view of the tensile force applied to the entire wire. One way to measure the diameter of the magnetic wire with the insulating layer is to use non-contact measuring techniques, such as a laser optical measurement. One way to measure the diameter of the magnetic wire without the insulating layer (i.e. the diameter of the bare metal alloy wire) is to measure inductance or impedance of a coil when the magnetic wire is inserted into the coil. This was made possible based on the inventors' discovery that the measured vales of the inductance or impedance of the wire is proportional to the diameter of the metal alloy wire. Based on the measurements, the diameter of the bare magnetic wire without the insulating layer can be calculated.

Finally, the productivity has been improved by the continuous heat treatment of a long wire, for example one kilometer or longer, while raising the feed speed based on the insight below. The diameter of magnetic wire for the heat treatment under tensile force is as small as about 10-100 μm, while the addition of the size measuring device and the tensile force measuring device makes the distance between the wire supply bobbin and the wire winding bobbin that much longer. In view of this, the supply rotary part and the winding rotary part are placed in the wire supply unit and the wire winding unit, respectively. One tension roller each is placed in the wire supply unit, just after the after measurement capstan, and just after the after heat treatment capstan. Because of this configuration, it is possible to adjust the feed speed at the supply rotary part and the winding rotary part and at the two capstans and to adjust the tensile force load applied by the tension rollers by continuously measuring the tensile force due to uneven rotations and due to uneven frictions between the wire and the wire reels and capstans as well as measuring uneven feed speed. As a result, a continuous heat treatment with a faster feed speed can be achieved because the tensile force and the feed speed are kept constant at respective parts of the magnetic wire. Likewise, the fracture of the magnetic wire can be also prevented.

In brief, the apparatus for heat treating the magnetic wire includes the wire property measuring unit, the wire tensile force measuring unit and a tension roller placed between the supply rotary part and the winding rotary part and uses these components to control the temperature and the stress of the magnetic wire so that they fall within predetermined ranges.

As a result, magnetic wires having predetermined magnetic properties are produced in a stable manner (i.e., the entire magnetic wire has predetermined magnetic properties) even when an extremely long wire, for example of a length of one kilometer or longer, is heat treated by the apparatus. In addition, the tensile force and the feed speed are kept constant so that a high feed speed is maintained for a long operation period so as to improve production efficiency.

DETAILED DESCRIPTION OF THE INVENTION

Figure 1:
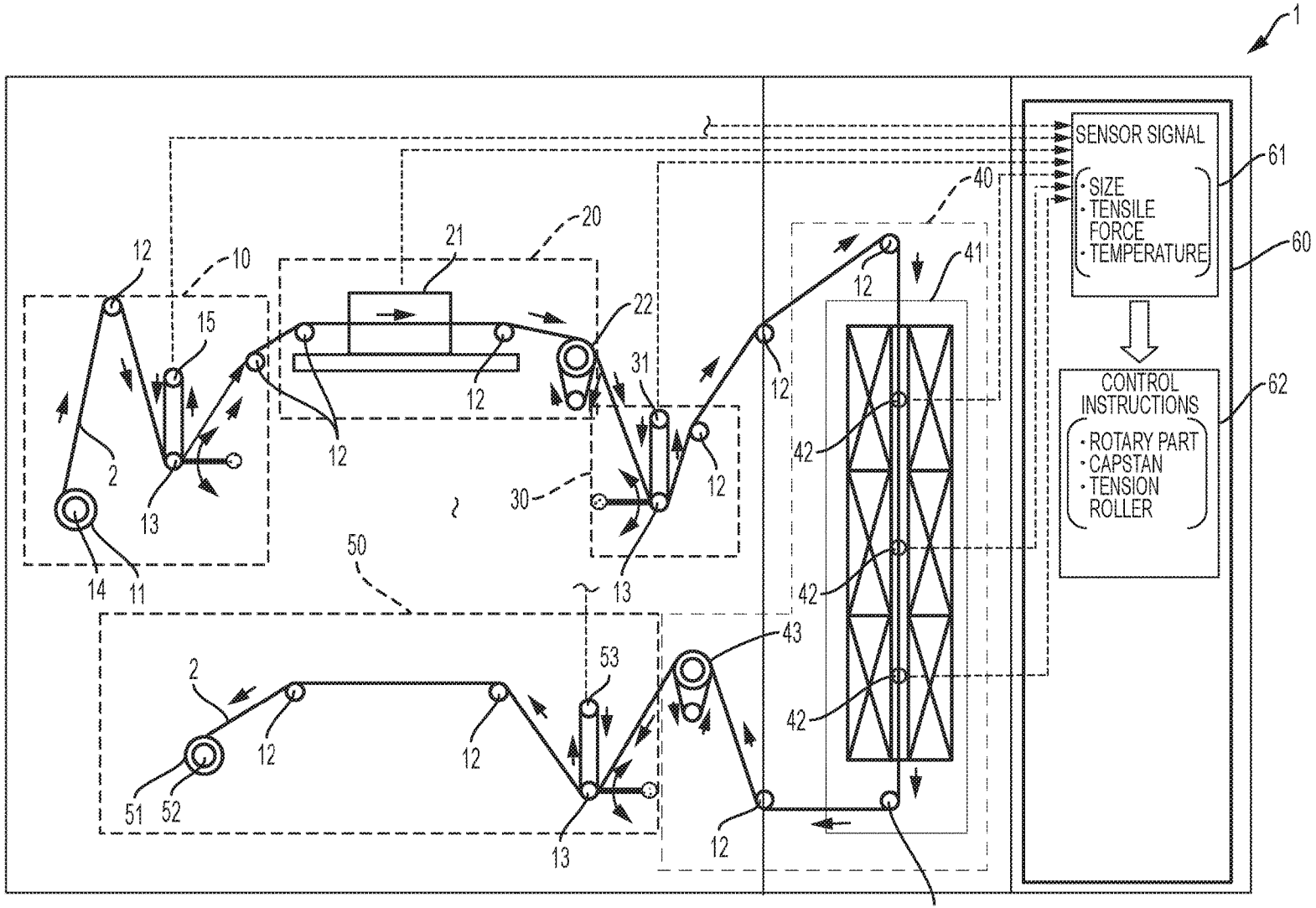
FIG. 1 is a conceptual diagram showing an embodiment of the apparatus for heat treating magnetic wire.

FIG. 1 shows an embodiment of the apparatus for heat treating a magnetic wire of the invention. Apparatus 1 for heat treating a magnetic wire 2 includes a wire supply unit 10, a wire property measuring unit 20, a wire tensile force measuring unit 30, a heat treatment unit 40, a wire winding unit 50, and a control unit 60. The wire supply unit 10 includes a supply bobbin 11, around which the magnetic wire 2 to be heat treated is wound, a supply rotary part 14 that rotates the supply bobbin 11, a wire reel 12, a tension roller 13, and a tensile force measuring device 15. The wire property measuring unit 20 includes a size measuring device 21, an after measurement capstan 22, and a wire reel 12 and measures a size of the wire 2 prior to the heat treatment. The wire tensile force measuring unit 30 includes a tensile force measuring device 31, a tension roller 13, and a wire reel 12. The wire heat treatment unit 40 includes a heat treatment furnace 41, a temperature measuring device 42, an after heat treatment capstan 43, and a wire reel 12. The wire winding unit 50 includes a winding bobbin 51, around which the heat treated magnetic wire 2 is wound, a winding rotary part 52 that rotates the winding bobbin 51, a tension roller 13, a tensile force measuring device 53, and a wire reel 12.

Because the after measurement capstan 22 and the after heat treatment capstan 43 are placed between the wire supply unit 10 and the wire winding unit 50 at two respective positions (i.e., before and after the furnace 41), the region of the magnetic wire 2 between the two capstans 22 and 43, including the region of the furnace 41, is isolated from other regions of the magnetic wire (i.e., the region between the supply rotary part 14 and the after measurement capstan 22, and the region between the after heat treatment capstan 43 and the winding rotary part 52). Accordingly, the tensile force in each region is controlled independently.

The control unit 60 includes sensor signal 61 including signals of wire size, tensile force and furnace temperature and control instruction 62 to maintain at predetermined values the temperature and the stress of the magnetic wire 2 in the furnace 41 and the wire winding unit 50. The tensile force measuring device 15 of the wire supply unit 10 and the tensile force measuring device 53 of the wire winding unit 50 are installed as necessary. These tensile force measuring devices 15 and 53 may be omitted depending on the specification of the apparatus 1.

The control unit 60 receives the wire diameter measured by the size measuring device 21, the tensile force applied to the wire 2 measured by the tensile force measuring device 31, the tensile force measured by the tensile force measuring devices 15 and 53 if necessary, the temperature of the furnace 41 measured by the temperature measuring device 42, the wire feed speeds of the supply rotary part 14 and the winding rotary part 52, the wire feed speeds of the after measurement capstan 22 and the after heat treatment capstan 43, and the tensile forces of the tension rollers 13. Based on these parameters received, the control unit 60 controls the wire feed speeds of the supply rotary part 14 and the winding rotary part 52, the wire feed speeds of the after measurement capstan 22 and the after heat treatment capstan 43, and the tensile forces of the tension rollers 13, so that the temperature and the stress of the magnetic wire 2 in the furnace 40 fall within predetermined ranges.

In the apparatus 1 for heat treating the magnetic wire 2, the magnetic wire 2 is pulled from the wire supply unit 10, and the wire diameter is measured at the wire property measuring unit 20. Then, a tensile force corresponding to the measured wire diameter is determined in view of the stress to be induced in the wire, and the tensile force and the feed speed are adjusted by the tension roller 13 and the after measurement capstan 22. The tensile force is measured accurately by the wire tensile force measuring unit 30, and the magnetic wire 2 is heat treated at predetermined tensile force (and thus a predetermined stress) and temperature at the heat treatment unit 40. Thereafter, the wire 2 is transferred to the wire winding unit 50 upon the adjustment of the feed speed by the after heat treatment capstan 43. Finally, the wire 2 is wound around the winding bobbin 51 upon the adjustment of the tensile force and the feed speed by the tension roller 13 and the winding rotary part 52.

Figure 2:
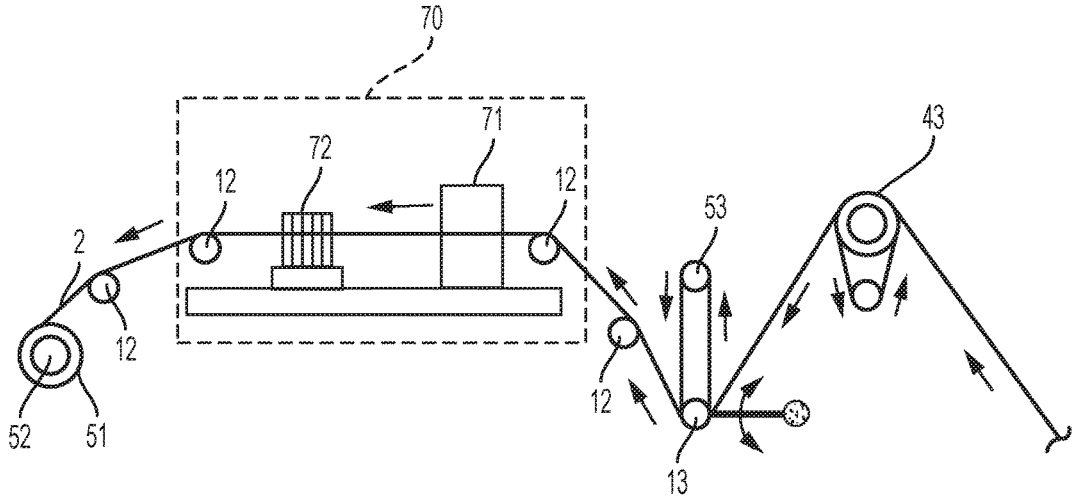
FIG. 2 is a conceptual diagram showing a modification to the apparatus shown in FIG. 1.

Alternately, another wire property measuring unit 70, which is similar to the wire property measuring unit 20, may be provided after the wire 2 is heat treated under the predetermined tensile force and temperature in the wire heat treatment unit 40 and before it is transferred to the wire winding unit 50. This configuration is shown in FIG. 2. The another wire property measuring unit 70 includes a magnetism measuring device 72 that measures the magnetic properties of the magnetic wire 2 in addition to the size measuring device 71 that measures the size of the wire 2 after the heat treatment. Accordingly, the apparatus so constructed can measure the size and magnetic properties of the magnetic wire 2 after the heat treatment.

Although the control unit 60 adjusts the tensile force and the temperature of the magnetic wire 2 properly based on the wire size measured before the heat treatment, it is still important to measure and confirm the wire size and the magnetic properties of the magnetic wire 2 made by the heat treatment. When the wire size and the magnetic properties measured after the heat treatment fall outside the predetermined ranges, the tensile force and the feed speed are further adjusted so that the measured values fall within the predetermined ranges, or the heat treatment may be temporarily halted, so that production of defective products may be avoided. It is noted that the wire property measuring unit 70 does not need to have both the size measuring device 71 and the magnetism measuring device 72. For example, it may have only the size measuring device 71.

The magnetic wires 2 heat treated by the apparatus 1 include magnetic wires made by a rotating liquid spinning process and magnetic wires covered by a glass layer. For example, the magnetic wire 2 may be a magnetic amorphous wire having a diameter of about 10 to 30 μm. The supply bobbin 11 may have a drum diameter of 30 mm with a flange and is able to wind a magnetic wire of a length of 1 to 5 km.

The wire reel 12 may be of a V-groove type. The tension roller 13 used for adjusting the tensile force may be a tension roller that can adjust the tensile force in the range between about 0.5 to 20 g with an adjustment accuracy of 0.1 g, which is used to adjust the stress induced in a magnetic wire having a diameter of 10 to 30 μm.

The supply rotary unit 14, the winding rotary part 52, the after measurement capstan 22, and the after heat treatment capstan 43 are able to adjust respective rotation speeds in a wide range. For example, it is preferable that they can adjust the rotation speed in a rage of about 1 to 1000 meter per minute. The heat treatment furnace 41 is, preferably, of a vertical type in which the magnetic wire 2 is not subject to bending stress and may have a length of about 10 to 150 cm. The structure of the furnace 41 can be designed flexibly as long as the magnetic wire 2 is not subject to significant bending stress and may be of a structure that allows for a three-zone control for even heating. If a three-zone control is used, the temperature measuring device 42 is preferably a multi-point thermocouple that can measure temperatures at three points corresponding to the three zones of the three-zone control.

Figure 3:
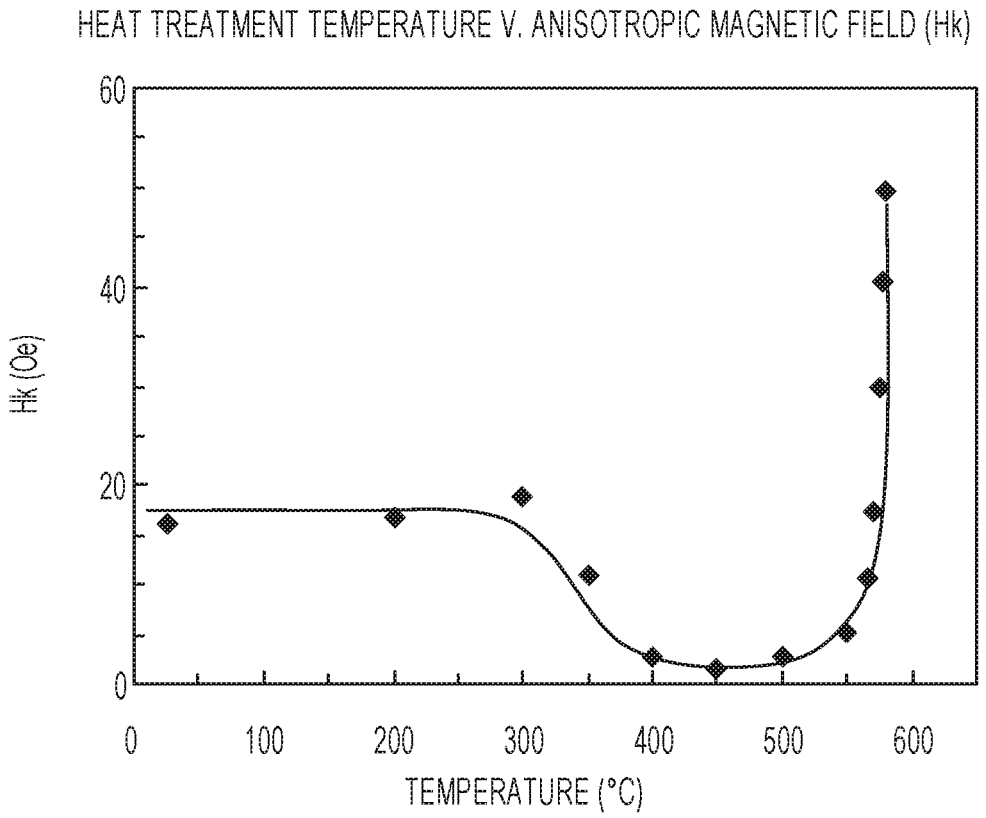
FIG. 3 shows the anisotropic magnetic field of the magnetic wire prepared in one embodiment as a function of the heat treatment temperature.

FIG. 3 shows the anisotropic magnetic field v. heat treatment temperature characteristic of a magnetic wire prepared in one example using the apparatus 1. As shown in FIG. 3, the heat treatment temperature is one of the most significant parameters in heat treating the magnetic wire 2. The amorphous state of the magnetic wire 2 must be maintained after the heat treatment so as to avid deterioration of the magnetic properties, so the heat treatment temperature should be below the crystallization temperature of the amorphous magnetic wire 2. On the other hand, the productivity must also be considered, so the heat treatment temperature should be a high temperature within the temperature range that avoids the crystallization. For example, a heat treatment temperature of about 400° C. to 550° C. is used, and it may vary depending on the composition of the alloy of the magnetic wire 2. It is noted that heat treatment temperatures close to 550° C. may give rise to crystallization of the amorphous magnetic wire 2 and thus are not preferable. The magnetic wire 2 passes through the heat treatment furnace 41 in a short time. Accordingly, the heat treatment temperature must be set accurately so that the magnetic wire 2 passing through the heat treatment furnace 41 rapidly is heated at a predetermined temperature.

The hysteresis of the magnetic wire 2 becomes smaller when the stress induced in the magnetic wire 2 during the heat treatment becomes larger. On the other hand, the stress during the heat treatment also influences the anisotropic magnetic field (Hk) of the magnetic wire 2 produced by the heat treatment. Accordingly, the stress induced in the magnetic wire 2 during the heat treatment should be determined in view of both the hysteresis and the anisotropic magnetic field (Hk) depending on the specification of the magnetic sensor in which the magnetic wire 2 is used. In addition, a high stress may give rise to an excessively high friction between the rollers and the magnetic wire 2, which may result in a fracture of the magnetic wire 2. Thus, it is important to control the tensile force applied to the magnetic wire 2 so that it falls in a predetermined range. In other words, the stress induced in the magnetic wire 2 should be adjusted accurately so as to produce magnetic wire 2 having predetermined magnetic properties.

To this end, the apparatus includes before the furnace 41 the size measuring device 21, which measures the diameter of the magnetic wire 2, and the tensile force measuring device 31, which accurately measures the tensile force. The size measuring device 21 measures the wire diameter before the magnetic wire 2 enters the furnace 41. The control unit 60 receives a signal indicating the measured wire diameter, determines a tensile force to be applied to the magnetic wire 2 depending on the measured wire diameter, and controls the tension roller 13 of the wire tensile force measuring unit 30 so that the tensile force measured by the tensile force measuring device 31 corresponds to the determined tensile force. The stress induced in the wire 2 in the furnace 41 is adjusted in this manner. In addition, the feed speeds of the supply rotary part 14, the capstans 22 and 42 are adjusted to be essentially the same as the feed speed of the winding rotary part 52.

The size measuring device 21 may be a non-contact measuring device having a capability of measuring a wire diameter of, for example, 10 to 30 μm with a resolution of about 0.5 μm. Examples of such non-contact measuring devices include a laser size measuring device, a size measuring device based on magnetic impedance and inductance, and a size measuring device having a microscope. Preferably, the tensile force measuring device 31 measures a tensile force in a range of about 0 to 2000 MPa with a measuring accuracy of 1 MPa. For example, the tensile force measuring device 31 may include a strain gauge that measures the tensile force applied to the rollers on which the magnetic wire 2 is wound.

It is noted that the distance between the supply bobbin 11 and the winding bobbin 51 becomes longer when the apparatus 1 includes the size measuring device 21 and the tensile force measuring device 31. In addition, the stresses induced in the magnetic wire 2 are different along the path of the magnetic wire 2 in the apparatus 1. Specifically, the stress of the wire 2 supplied from the supply bobbin 11, the stress of the wire 2 in the heat treatment furnace 41, and the stress of the wire 2 wound around the winding bobbin 51 after the heat treatment are different.

To account for the above, the after measurement capstan 22 and the after heat treatment capstan 43 are provided as shown in FIG. 1, and the tension rollers 13 are provided between the supply rotary part 14 and the after measurement capstan 22, between the after measurement capstan 22 and the after heat treatment capstan 43, and between the after heat treatment capstan 43 and the winding rotary part 52. In this configuration, the tensile forces generated in the respective portions and uneven feed speeds due to uneven rotations and due to uneven frictions between the wire and the wire reels 12, the rotary parts 14 and 52, and the capstans 22 and 43 are continuously measured and fed to the control unit 60. The feed speeds of the capstans 22 and 43 and the tensile load of the tension rollers 13 are adjusted based on the input to the control unit 60, so that the tensile force and the feed speed in the respective portions are kept constant. As a result, a magnetic wire longer than 1 km is heat treated in a wide feed speed range of about 1 to 100 m/minute without fracturing the magnetic wire.

It is important to note that the magnetics wire 2 heat treated in this manner may still produce products with somewhat varying properties. The wire property measuring unit 70 provided after the furnace 41 and before the wire winding unit 50 serves to detect such variations in the properties in that event.

A magnetic wire coated with an insulating layer, such as a glass layer, can be also heat treated by the apparatus explained above. In this case, the apparatus 1 needs to measure both the diameter of the magnetic wire 2 including the insulating layer and the diameter of the wire 2 without the insulating layer, based on which the stress induced during the heat treatment in the wire 2 without insulating layer is calculated in view of the tensile force applied to the entire wire. To this end, the wire property measuring unit 20 may include two different size measuring devices. Specifically, one of the two size measuring devices may be a laser optical measuring device that measures the diameter of the whole magnetic wire 2 with the insulating layer (i.e., the outer diameter of the wire 2). The other of the two size measuring devices may be an inductance/impedance based size measuring device that measures the diameter of the magnetic wire without the insulating layer (i.e. the diameter of the bare metal alloy wire) based on inductance or impedance of a coil when the magnetic wire 2 is inserted into the coil.

Examples of methods of heat treating magnetic wires using the apparatus 1 for heat treating the magnetic wire 2, which is described in detail above, are explained below.

In short, the diameter of the magnetic wire 2 is measured at the wire property measuring unit 20, the heat treatment temperature is measured at the heat treatment unit 40, and the speed of winding the magnetic wire 2 is measured at the wire winding unit 50. Based on the respective measured values, the temperature of the magnetic wire 2 in the furnace 41 is maintained at a temperature in a range of about 400° C. to 550° C., the stress induced in the magnetic wire 2 in the furnace 41 is maintained at a stress in a range of about 50 to 250 MPa, and the feed speed is maintained at a speed in a range of about 1 to 100 meter per minute. The control unit 60 includes a processor and a memory that has a program stored therein, which implements this method when executed by the processor.

Further, the magnetic wire 2 is pulled out from the wire supply unit 10, and the wire diameter is measured at the wire property measuring unit 20. Then, a target tensile force to be applied to the portion of the magnetic wire 2 having the measured diameter is determined based on the measured wire diameter, and the tensile force actually applied to the magnetic wire 2 is measured accurately at the wire tensile force measuring unit 30. The tensile force load by the tension roller 13 and the feed speed of the after measurement capstan 22 are adjusted so that the measured tensile force becomes essentially the same (i.e., within the accuracy of the measurement) as the determined target tensile force. After these adjustments, the magnetic wire 2 enters the heat treatment unit 40 so that it is heat treated at a predetermined stress and temperature in the furnace 41. After the treatment, the feed speed is adjusted by the after heat treatment capstan 43, and the magnetic wire 2 is transferred to the wire winding unit 50, in which the magnetic wire 2 is wound around the winding bobbin 51, while the tensile force and the feed speed are adjusted by the tension roller 13 and the winding rotary part 52. As noted earlier, the wire property measuring unit 70 provided after the furnace 41 and before the wire winding unit 50 may serve to check and confirm the size and magnetic properties of the magnetic wire 2 after the heat treatment.

In one example, an amorphous magnetic wire made by a rotating liquid spinning process and having a diameter of 10 μm was heat treated by the apparatus 1 as the magnetic wire 2. The supply bobbin 11 had a drum diameter of 30 mm and a flange. The magnetic wire 2 of a length of 1 km was wound around the supply bobbin 11. The wire reel 12 was of a V-groove type. The tension roller 13 applied a predetermined tensile force of 2 gram to the magnetic wire 2. The deviation from the predetermined tensile force during the heat treatment operation was detected with an accuracy of 0.1 gram, and the detection signal is fed to the control unit 60, which in turn controlled the tensile force so that it stayed at 2 gram while the predetermined tensile force is 2 gram. The supply rotary part 14, the winding rotary part 52, the after measurement capstan 22, and the after heat treatment capstan 43 were adjusted so that the feed speed of the magnetic wire 2 became 10 m/minute. The variation of the rotation speeds during the heat treatment operation was detected with an accuracy of 0.01 RPM, and the detection signals were fed to the control unit 60, which in turn controlled the rotary parts 14 and 52 and the capstans 22 and 43 so that the feed speeds were kept at 10 m/minute. The heat treatment furnace 41 was of a vertical type to avoid application of bending stresses to the magnetic wire 2 and had a length of 100 cm.

As explained above with respect to FIG. 3, the heat treatment temperature is one of the most significant parameters in heat treating the magnetic wire 2, which affects the magnetic properties of the magnetic wire 2. In this example, the heat treatment temperature was set at 530° C. Since the feed speed of the magnetic wire 2 was 10 m/minute and the length of the furnace 41 was 100 cm, the time for a specific portion of the magnetic wire 2 to pass through the furnace 41 was 6 seconds. Under this condition, the temperature of the magnetic wire 2 was kept near 530° C. for a suitable period. Further, care was taken so that the elongation of the magnetic wire 2 during the heat treatment fell within a tolerance range to avoid significant variation of the stresses induced in the magnetic wire 2 in the furnace 41.

When the stress induced in the magnetic wire 2 during the heat treatment is larger, the hysteresis of the magnetic wire 2 becomes smaller, as explained above. The tensile force of 2 gram monitored by the accuracy of 0.1 gram for feedback control, as explained above, resulted in a coercivity (Hcj), which is a good measure of the hysteresis, of smaller than 1 Oe, and in some cases, smaller than 0.1 Oe. Further, the continuous heat treatment of the 1 km long amorphous magnetic wire 2 does not result in fracture of the wire.

During the heat treatment, the stress induced in the magnetic wire 2 was controlled based on the measurement of the diameter of the magnetic wire 2 by the size measuring device 21 and the measurement of the tensile force by the tensile force measuring device 31, as explained above. Further, the tension rollers 13, the supply rotary part 14, the winding rotary part 52, the after measurement capstan 22, and the after heat treatment capstan 43 were used to adjust the tensile force and the feed speed so as to maintain the stress induced in the magnetic wire 2 in a predetermined range.

The size measuring device 21 of the wire property measuring unit 20 was a laser size measuring device that can perform non-contact measuring of wires having a diameter of 10 to 100 μm with a resolution of 0.5 μm. The results of the measurements were fed to the control unit 60 and recorded with the respective positions of the wire where the measurements were performed. When a specific portion of the magnetic wire 2 having a corresponding measured wire diameter was inserted into the furnace 41, the tensile force at that time was measured so that the stress induced in the magnetic wire 2 in the furnace 41 was calculated. The above explained feedback control was performed so that the calculated stress was maintained in a predetermined stress of 200 MPa. The tensile force measuring device 31 was a strain gauge that measures the tensile force applied to the rollers on which the magnetic wire 2 is wound.

The distance between the supply bobbin 11 and the winding bobbin 51 became longer by 4 meters because of the addition of the size measuring device 21 and the tensile force measuring device 31. The after measurement capstan 22, the after heat treatment capstan 43, the tension rollers 13, the supply rotary part 14, and the winding rotary part 52 accounted for the addition of the extra passage, as explained above.

In this configuration, the tensile forces generated in the respective portions and uneven feed speeds due to uneven rotations and due to uneven frictions between the wire and the wire reels 12, the rotary parts 14 and 52, and the capstans 22 and 43 were continuously measured and fed to the control unit 60. The feed speeds of the capstans 22 and 43 and the rotary parts 14 and 52 and the tensile load of the tension rollers 13 were adjusted based on the input to the control unit 60, so that the tensile force and the feed speed in the respective portions were kept constant. As a result, the magnetic wire 2 having a length of 1 km was heat treated at a feed speed of 100 m/minute without fracturing the magnetic wire 2.

The example above proves that the apparatus for heat treating magnetic wire described above is capable of continuous heat treatment of amorphous magnetic wires at a predetermined temperature, for example, 530° C., chosen from a predetermined range of 400° C. to 550° C., while the stress induced in the magnetic wire during the heat treatment and the feed speed are properly maintained. Since a magnetic wire of a length of more than 1 km can be heat treated continuously, efficient mass product of magnetic sensors is possible.

The target values of the anisotropic magnetic field (Hk) vary depending on the specification of the magnetic sensors in which the magnetic wires are used. The apparatus for heat treating magnetic wires described above is designed so that magnetic wires having various magnetic properties are properly manufactured in a mass production scale by adjusting parameters described above. Accordingly, efficiency and productivity in manufacturing magnetic wires are significantly improved.

In other example, a magnetic wire coated with a glass layer was used as the magnetic wire 2, instead of the bare amorphous alloy wire without any coatings made by a rotating liquid spinning process. The wire property measuring unit 20 includes a laser optical measuring device that measures the diameter of the whole magnetic wire 2 with the insulating layer and an inductance/impedance based size measuring device that measures the diameter of the magnetic wire without the insulating layer based on inductance or impedance of a coil when the magnetic wire 2 is inserted into the coil, as explained above.

When a magnetic wire coated with a glass layer is heat treated, the tensile force applied to the magnetic wire 2 before the heat treatment is applied to the entire wire 2 including the glass layer. Under this condition, it was assumed that the glass layer does not contribute to bearing the tensile force when the wire 2 is heated in the furnace 41. With this assumption, the stress induced in the magnetic wire 2 during the heat treatment was calculated by dividing the tensile force measured by the tensile force measuring device 31 by the surface area of the cross section of the bare magnetic wire 2 corresponding to the diameter of the bare amorphous alloy wire without the glass layer. The adjustments of the stress induced in the magnetic wire 2 and feed speed of the magnetic wire 2 were performed in a manner similar to those of the example explained above. Specifically, the temperature of the magnetic wire 2 in the furnace 41 is maintained at a temperature in a range of about 400° C. to 550° C., the stress induced in the magnetic wire 2 in the furnace 41 is maintained at a stress in a range of about 50 to 250 MPa, and the feed speed is maintained at a speed in a range of about 1 to 100 meter per minute.

The apparatus for heat treating magnetic wires and the method of heat treating magnetic wires described above are able to produce magnetic wires to be used as magnetism detecting bodies in magnetic sensors, such as a high sensitivity MI sensor, while allowing the magnetic properties of the magnetic wires to be modified according to the specifications of the magnetic sensors. The apparatus and the method also improve the efficiency and productivity of the mass production of magnetic wires.

What is claimed is:

1. Apparatus for heat treating a magnetic wire, comprising:

a wire supply unit comprising a supply bobbin, around which the magnetic wire to be heat treated is wound, a supply rotary part that rotates the supply bobbin, a wire reel, and a tension roller;

a wire property measuring unit comprising a size measuring device, an after measurement capstan, and a wire reel and measuring a size of the wire prior to heat treatment;

a wire tensile force measuring unit comprising a tensile force measuring device, a tension roller, and a wire reel;

a wire heat treatment unit comprising a heat treatment furnace, a temperature measuring device, an after heat treatment capstan, and a wire reel;

a wire winding unit comprising a winding bobbin, around which the heat treated magnetic wire is wound, a winding rotary part that rotates the winding bobbin, a tension roller, and a wire reel; and a control unit comprising a processor and a memory, wherein the control unit is configured to receive signals indicative of the size of the magnetic wire measured by the size measuring device, a tensile force of the magnetic wire measured by the tensile force measuring device, a temperature of the heat treatment furnace measured by the temperature measuring device and to receive signals from the capstans, and configured to send control signals to the capstans and the tension rollers so that the tensile force applied to the magnetic wire between the supply bobbin and the winding bobbin is adjusted using the tension rollers, and a winding speed of the winding bobbin is adjusted using the after measurement capstan and the after heat treatment capstan, so that the temperature, a conveyance speed in the heat treatment furnace and a stress induced in the magnetic wire in the furnace are maintained in respective predetermined ranges.

2. The apparatus of claim 1, further comprising another wire property measuring unit that is provided after the wire heat treatment unit and measures a size of the wire heat treated by the wire heat treatment unit.

3. The apparatus of claim 2, wherein said another wire property measuring unit comprises a magnetism measuring device that measure magnetic properties of the wire heat treated by the wire heat treatment unit.

4. The apparatus of claim 1, wherein the wire property measuring unit is configured to measure, when the magnetic wire includes an insulating layer covering the magnetic wire, both a diameter of the whole magnetic wire with the insulating layer and a diameter of the magnetic wire without the insulating layer.

5. The apparatus of claim 1, wherein the winding speed of the winding bobbin is adjusted using the supply rotary part and the winding rotary part in addition to the after measurement capstan and the after heat treatment capstan.

6. The apparatus of claim 1, wherein the apparatus is configured to measure the winding speed of the winding bobbin.

* * * * *